US011776489B2

(12) United States Patent
Maekawa et al.

(10) Patent No.: US 11,776,489 B2
(45) Date of Patent: Oct. 3, 2023

(54) LIQUID CRYSTAL DISPLAY DEVICE HAVING A CONTROL DEVICE FOR TONE MAPPING

(71) Applicant: Panasonic Intellectual Property Management Co., Ltd., Osaka (JP)

(72) Inventors: Yusuke Maekawa, Hyogo (JP); Kazuhiro Uehara, Osaka (JP); Akira Yoneda, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/785,781

(22) PCT Filed: Sep. 30, 2020

(86) PCT No.: PCT/JP2020/037101
§ 371 (c)(1),
(2) Date: Jun. 15, 2022

(87) PCT Pub. No.: WO2021/131209
PCT Pub. Date: Jul. 1, 2021

(65) Prior Publication Data

US 2023/0059318 A1 Feb. 23, 2023

Related U.S. Application Data

(60) Provisional application No. 62/953,287, filed on Dec. 24, 2019.

(51) Int. Cl.

| | |
|---|---|
| ***G09G 3/34*** | (2006.01) |
| ***G09G 3/20*** | (2006.01) |
| ***G09G 3/36*** | (2006.01) |

(52) U.S. Cl.
CPC ..... *G09G 3/3406* (2013.01); *G09G 3/2007* (2013.01); *G09G 3/36* (2013.01);
(Continued)

(58) Field of Classification Search
CPC ..... G09G 3/3406
(Continued)

(56) References Cited

U.S. PATENT DOCUMENTS 9,319,620 B2 4/2016 Fujine et al.
9,495,921 B2 11/2016 Fujine et al.
(Continued)

FOREIGN PATENT DOCUMENTS

CN 108806616 A 11/2018
EP 1705636 B1 8/2010
(Continued)

OTHER PUBLICATIONS

International Search Report dated Nov. 17, 2020 in International Patent Application No. PCT/JP2020/037101, with English translation.
(Continued)

*Primary Examiner* — Long D Pham
(74) *Attorney, Agent, or Firm* — McDermott Will & Emery LLP

(57) ABSTRACT

A control device that controls a liquid crystal display device, the control device includes: an obtainer that obtains a first video signal; a determiner that determines a first backlight value as a reference luminance of a backlight of the liquid crystal display device, using a first luminance characteristic of the first video signal; a tone map processor that performs tone mapping on the first video signal based on the first backlight value and a peak luminance displayable by the liquid crystal display device, and outputs a second video signal obtained through the tone mapping; and a generator
(Continued)

that generates a control signal for local dimming control on the liquid crystal display device based on the first backlight value and the second video signal, and outputs the control signal to the liquid crystal display device.

12 Claims, 9 Drawing Sheets

(52) U.S. Cl.
CPC ..... *G09G 2320/0257* (2013.01); *G09G 2320/0646* (2013.01); *G09G 2340/16* (2013.01)

(58) Field of Classification Search
USPC ..... 345/102
See application file for complete search history.

(56) References Cited

U.S. PATENT DOCUMENTS

| | | | | |
|---|---|---|---|---|
| 9,773,458 | B2 | 9/2017 | Sugimoto | |
| 2011/0025592 | A1 | 2/2011 | Botzas et al. | |
| 2012/0320105 | A1 | 12/2012 | Ueno et al. | |
| 2014/0368527 | A1 | 12/2014 | Fujine et al. | |
| 2015/0213766 | A1* | 7/2015 | Sugimoto | G09G 3/36 345/690 |
| 2017/0025074 | A1* | 1/2017 | Farrell | G09G 3/36 |

FOREIGN PATENT DOCUMENTS

| | | | |
|---|---|---|---|
| JP | 5085793 | B1 | 11/2012 |
| JP | 2013-161017 | A | 8/2013 |
| JP | 2013-167719 | A | 8/2013 |
| JP | 2015-142276 | A | 8/2015 |
| JP | 6185636 | B1 | 8/2017 |
| WO | 2011/111268 | A1 | 9/2011 |

OTHER PUBLICATIONS

Extended European Search Report dated May 9, 2023 issued in the corresponding European Patent Application No. 20906183.7.
Japanese Office Action dated Jul. 4, 2023 issued in the corresponding Japanese Patent Application No. 2021-566829.

* cited by examiner

LIQUID CRYSTAL DISPLAY DEVICE HAVING A CONTROL DEVICE FOR TONE MAPPING

CROSS-REFERENCE OF RELATED APPLICATIONS

This application is the U.S. National Phase under 35 U.S.C. § 371 of International Patent Application No. PCT/JP2020/037101, filed on Sep. 30, 2020, which in turn claims the benefit of U.S. Provisional Patent Application No. 62/953,287, filed on Dec. 24, 2019, the entire disclosures of which applications are incorporated by reference herein.

TECHNICAL FIELD

The present disclosure relates to a control device and a control method.

BACKGROUND ART

Patent Literature (PTL) 1 discloses a video display device provided with a backlight to which local dimming can be performed. In such a video display device, the backlight is divided into a plurality of areas, and luminance of light emitting elements belonging to the respective divided areas are dynamically controlled in accordance with luminance distribution of a video signal. With this control, black floating of a dark section in a video to be displayed is reduced and a contrast ratio of the video is improved.

CITATION LIST

Patent Literature

[PTL 1] Japanese Patent No. 6185636

SUMMARY OF INVENTION

Technical Problem

However, the video display device as disclosed in PTL 1 cannot sufficiently reduce the black floating of a dark section in a video to be displayed, and cannot sufficiently improve a contrast ratio of the video.

The present disclosure provides a control device and so on, which can sufficiently reduce the black floating of a dark section in a video to be displayed in a liquid crystal display device, and can sufficiently improve a contrast ratio of the video.

Solution to Problem

A control device according to the present disclosure is a control device that controls a liquid crystal display device, and includes: an obtainer that obtains a first video signal; a determiner that determines a first backlight value as a reference luminance of a backlight of the liquid crystal display device, using a first luminance characteristic of the first video signal; a tone map processor that performs tone mapping on the first video signal based on the first backlight value and peak luminance displayable by the liquid crystal display device, and outputs a second video signal obtained through the tone mapping; and a generator that generates a control signal for local dimming control on the liquid crystal display device based on the first backlight value and the second video signal, and outputs the control signal to the liquid crystal display device.

It should be noted that these comprehensive or specific aspects may be embodied by a system, a method, an integrated circuit, a computer program, or a computer-readable recording medium such as a CD-ROM, or may be embodied by any combination of the system, the method, the integrated circuit, the computer program, and the recording medium.

Advantageous Effects of Invention

A control device according to the present disclosure can sufficiently reduce the black floating of a dark section in a video to be displayed in a liquid crystal display device, and can sufficiently improve a contrast ratio of the video.

DESCRIPTION OF EMBODIMENTS

Knowledge Underlying the Present Disclosure

Figure 1:
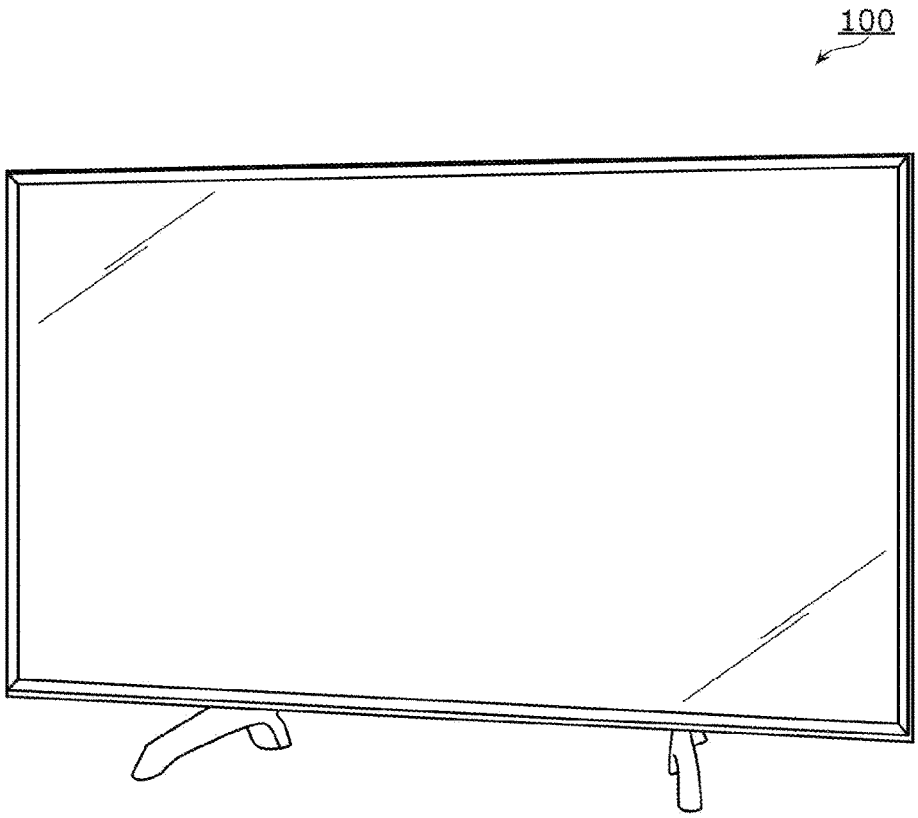
FIG. 1 is a perspective view showing an example of the appearance of a liquid crystal display device according to the present embodiment.

In a video display device, such as the device disclosed in PTL 1, when a backlight is controlled by local dimming, luminance of the backlight in an area to be controlled is adjusted so that the luminance corresponds to the maximum value of luminance of a video signal in the area. In other words, if the luminance of the video signal in the area to be controlled is low, the luminance of the backlight is lowered so as to reduce black floating of a dark section. At this time, control is performed in such a manner that a gain of signal compensation of the video signal is increased by magnitude corresponding to the lowered luminance of the backlight, so as to allow the luminance of the video signal to be consistent with original luminance.

However, the gain of the signal compensation should be increased as the luminance of the backlight is decreased. In order to increase the gain of the signal compensation, it is necessary to increase a scale of a circuit that performs the signal compensation. In other words, if the circuit scale is not increased, it is difficult for the luminance of the backlight to be lowered sufficiently due to an upper limit of the gain of the signal compensation. As a result, the black floating of a dark section in a video to be displayed cannot be sufficiently reduced, and a contrast ratio of the video cannot be sufficiently improved.

Hereinafter, embodiments of the present disclosure are described in detail, with appropriately reference to the drawings. Here, unnecessarily detailed description may be omitted. For example, detailed description for well-known matters and duplicate description for substantially the same configuration may be omitted. This prevents the below description from becoming unnecessarily redundant, to facilitate the understanding by a person skilled in the art.

It should be noted that inventors provide the accompanying drawings and the description below for a person skilled in the art to sufficiently understand the present disclosure, and thus do not intend to limit the subject matters recited in the scope of claims, by the drawings and the description.

In order to solve the problem described above, a control device according to an aspect of the present disclosure is a control device that controls a liquid crystal display device, and includes: an obtainer that obtains a first video signal; a determiner that determines a first backlight value as a reference luminance of a backlight of the liquid crystal display device, using a first luminance characteristic of the first video signal; a tone map processor that performs tone mapping on the first video signal based on the first backlight value and a peak luminance displayable by the liquid crystal display device, and outputs a second video signal obtained through the tone mapping; and a generator that generates a control signal for local dimming control on the liquid crystal display device based on the first backlight value and the second video signal, and outputs the control signal to the liquid crystal display device.

According to the control device, the control signal for the local dimming control on the liquid crystal display device is generated based on the first backlight value determined using the first luminance characteristic of the first video signal and the second video signal obtained through the tone mapping on the first video signal. Accordingly, the local dimming control can be performed on the liquid crystal display device in accordance with the second video signal adjusted in correspondence with the peak luminance of a video to be displayed on the liquid crystal display device using the first luminance characteristic. This allows the second video signal to have luminance lower than or equal to luminance of the first video signal. Therefore, the black floating of a dark section in a video to be displayed in the liquid crystal device is sufficiently reduced, and a contrast ratio of the video can be sufficiently improved.

Furthermore, the first luminance characteristic may include a maximum value of a plurality of first luminance values and an average value of the plurality of first luminance values, the plurality of first luminance values being respectively of a plurality of first pixels that constitute a single first frame included in a first video to be represented by the first video signal. The first video may include a plurality of first frames including the single first frame. The determiner may determine, for each of the plurality of first frames, a weighted average of the maximum value and the average value of the plurality of first luminance values that constitute each of the plurality of first frames as the first backlight value.

Accordingly, even if the maximum values each calculated from a plurality of first luminance values are significantly different from each other between one first frame and a first frame next to the one first frame, sharpness of fluctuation in the luminance of a video displayed in the liquid crystal display device can be reduced.

Furthermore, a weight given to the maximum value in the weighted average may be set to increase in proportion to an increase in the average value of the plurality of first luminance values in a first frame to be processed.

Accordingly, even if the maximum values each calculated from a plurality of first luminance values are significantly different from each other between one first frame and a first frame next to the one first frame, sharpness of fluctuation in the luminance of a video displayed in liquid crystal display device can be reduced.

Furthermore, when the plurality of first pixels are counted in descending order of luminance value, the maximum value may be an average of the plurality of first luminance values of the plurality of first pixels each having a luminance value within a predetermined range in which a first luminance value of a first pixel counted at a number corresponding to a count value that is a predetermined threshold value is a reference luminance.

Furthermore, the average value may be a histogram average in a histogram indicating, for each of a plurality of luminance-value classes, a total number of pixels each having a luminance value categorized into a corresponding one of the plurality of luminance-value classes.

Furthermore, the tone map processor may calculate a displayed-image peak luminance when displaying the single first frame by the liquid crystal display device, from the peak luminance and the first backlight value, and may perform the tone mapping with using a tone curve having the displayed-image peak luminance as a maximum luminance.

Therefore, a second video signal can be generated, which is adjusted according to the peak luminance of a video to be displayed in the liquid crystal display device using the first luminance characteristic.

Furthermore, for each of a plurality of regions constituting a second frame that is included in a second video represented by the second video signal, and corresponds to the first frame, the generator: (i) may determine a second backlight value in the region using a second luminance characteristic of the region; (ii) may determine a gain of signal compensation to the second video signal for the region based on the second backlight value in the region, and compensates the second video signal in the region using the gain determined for the region; and may generate, as the control signal, a third backlight value in each of the plurality of regions, and a third video signal obtained by compensating the second video signal in each of the plurality of regions, the third backlight value being calculated based on the first backlight value and the second backlight value that is determined in each of the plurality of regions.

Therefore, the local dimming control in accordance with the second video signal can be appropriately performed.

It should be noted that these comprehensive or specific aspects may be embodied by a system, a method, an integrated circuit, a computer program, or a computer-readable recording medium such as a CD-ROM, or may be embodied by any combination of the system, the method, the integrated circuit, the computer program, and the recording medium.

Embodiments

Hereinafter, embodiments of the present disclosure are described, with reference to FIGS. 1 to 10.

1. Configuration

FIG. 1 is a perspective view showing an example of the appearance of a liquid crystal display device according to the present embodiment.

As shown in FIG. 1, liquid crystal display device 100 has the typical appearance of a flat panel display in which a display device including a display panel is accommodated in a housing.

Figure 2:
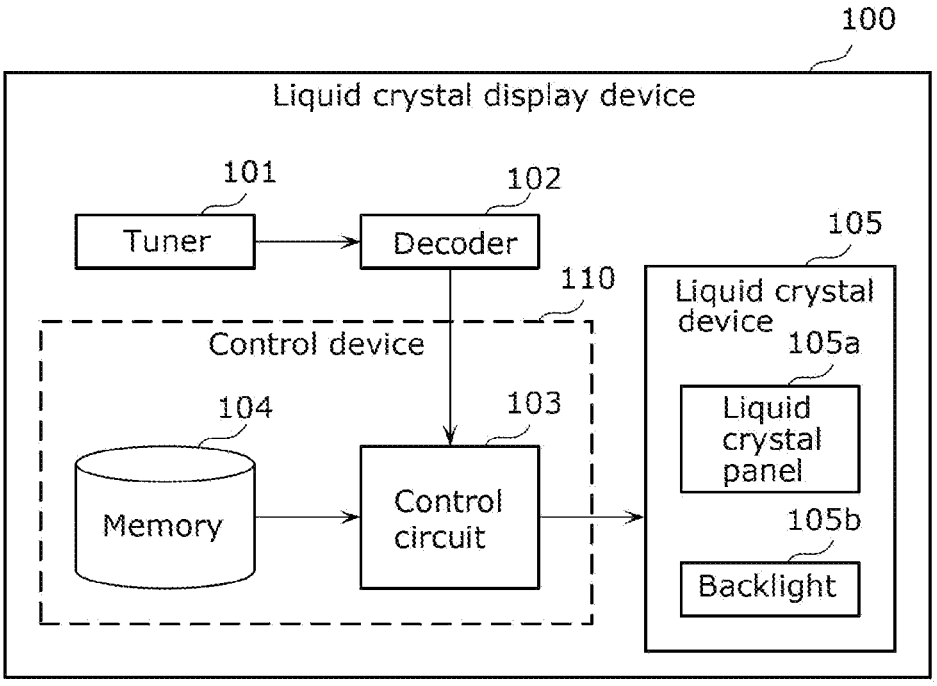
FIG. 2 is a block diagram showing an example of a hardware configuration of the liquid crystal display device according to the present embodiment.

FIG. 2 is a block diagram showing an example of a hardware configuration of the liquid crystal display device according to the present embodiment.

As shown in FIG. 2, liquid crystal display device 100 includes tuner 101, decoder 102, control circuit 103, memory 104, and liquid crystal device 105. Control circuit 103 and memory 104 constitute control device 110. Accordingly, liquid crystal display device 100 includes therein control device 110.

Tuner 101 converts an analog signal, which constitutes a broadcast wave and is received via an antenna (not shown), to coded data that is a digital signal, and outputs the coded data obtained by the conversion to decoder 102.

Decoder 102 decodes the coded data obtained from tuner 101, and outputs, to control circuit 103, a first video signal obtained by the decoding. If the coded data is multiplexed, decoder 102 may decode coded data for a video and coded data for voice, which are obtained by demultiplexing the coded data, respectively to a video signal (a first video signal) and a voice signal. Decoder 102 may obtain and decode, together with the first video signal, metadata that is additional data of the first video signal, from tuner 101. Decoded metadata is temporarily written into memory 104 by control circuit 103 described later. The metadata is added to the first video signal by distribution device 200 in advance and is distributed.

Control circuit 103 performs predetermined video processing to the first video signal outputted by decoder 102. Control circuit 103 performs, when a video represented by the video signal is a moving image, predetermined video processing to each of a plurality of frames contained in the moving image. Control circuit 103 performs, when the video is a still image, predetermined video processing to the still image. Control circuit 103 outputs a control signal obtained by performing the video processing, to liquid crystal device 105. Accordingly, liquid crystal device 105 can display a video that has undergone the video processing. The control signal obtained by control circuit 103 contains a third backlight value and a third video signal. The third backlight value and the third video signal are described later in detail.

It should be noted that decoder 102 and control circuit 103 may be embodied by the same circuit. In addition, control circuit 103 may be embodied by a general processor, such as a CPU, that executes a predetermined program or may be embodied by a dedicated circuit. In other words, the functions of liquid crystal display device 100 may be embodied by software, or may be embodied by hardware.

Memory 104 may store a predetermined program and various data to be used for executing the predetermined program. Memory 104 is a non-volatile memory, for example.

Liquid crystal device 105 display a video based on the control signal outputted by control circuit 103. Liquid crystal device 105 has liquid crystal panel 105*a* and backlight 105*b*. Backlight 105*b* has a plurality of light sources (not shown) provided respectively corresponding to a plurality of areas of liquid crystal panel 105*a*. Each light source can individually adjust luminance of each of the areas in liquid crystal panel 105*a*.

Next, a functional configuration of control device 110 is described.

Figure 3:
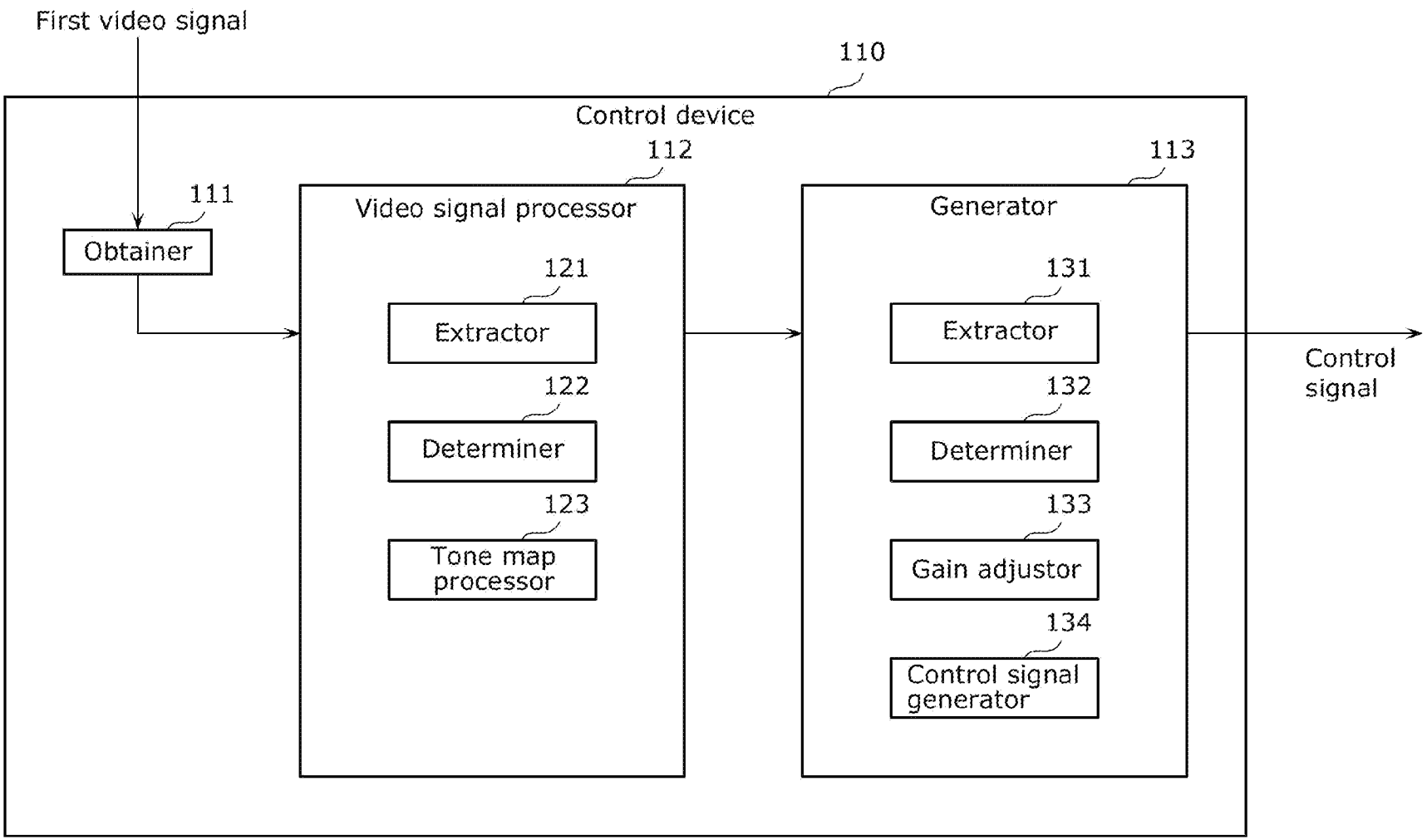
FIG. 3 is a block diagram showing an example of a functional configuration of a control device according to the present embodiment.

FIG. 3 is a block diagram showing an example of the functional configuration of a control device according to the present embodiment.

As shown in FIG. 3, control device 110 includes, as functional configurations, obtainer 111, video signal processor 112, and generator 113. Control device 110 is embodied by control circuit 103 and memory 104, for example. Specifically, control device 110 may be embodied in a manner that control circuit 103 executes a predetermined program stored in memory 104.

Obtainer 111 obtains the first video signal. It should be noted that the first video signal is a video signal that has not undergone signal processing by control device 110. The first video signal may be a high dynamic range (HDR) video signal, for example. The first video signal may also be a standard dynamic range (SDR) video signal. Obtainer 111 may obtain the first video signal obtained in a manner that a broadcast wave with a predetermined television broadcast standard is received. Obtainer 111 may also obtain the first video signal obtained via a network in a predetermined protocol, such as the Internet, and may also obtain the first video signal from a predetermined package media. In the present embodiment, the description is provided with reference to a case in which the first video signal is obtained, by using tuner 101 and decoder 102, from the broadcast wave in the predetermined television broadcast standard, as an example. Obtainer 111 is embodied by control circuit 103 and memory 104, for example. Specifically, obtainer 111 may be embodied in a manner that control circuit 103 executes a predetermined program stored in memory 104.

Next, video signal processor 112 is described.

Video signal processor 112 adjusts the first video signal obtained by obtainer 111 to a second video signal according to display performance of liquid crystal device 105. The second video signal is obtained in a manner that video signal processor 112 performs processing to the first video signal. Video signal processor 112 determines a first backlight value that is to be a standard of backlight 105*b* of liquid crystal display device 100. Video signal processor 112 outputs the second video signal and the first backlight value to generator 113. Video signal processor 112 includes extractor 121, determiner 122, and tone map processor 123. Video signal processor 112 is embodied by control circuit 103 and memory 104. Specifically, video signal processor 112 may be embodied in a manner that control circuit 103 executes a predetermined program stored in memory 104.

Extractor 121 extracts a first luminance characteristic of the first video signal, from the first video signal. Specifically, extractor 121 extracts the first luminance characteristic for each of a plurality of first frames included in a first video. Extractor 121 analyzes a plurality of first luminance values each of which is provided in the corresponding one of a plurality of pixels constituting each frame, to extract the first luminance characteristic based on a plurality of the first luminance values. The first luminance characteristic includes, for example, the maximum value of a plurality of the first luminance values (hereinafter, referred to as a first maximum value) and an average value of a plurality of the first luminance values (hereinafter, referred to as a first average value).

Figure 4:
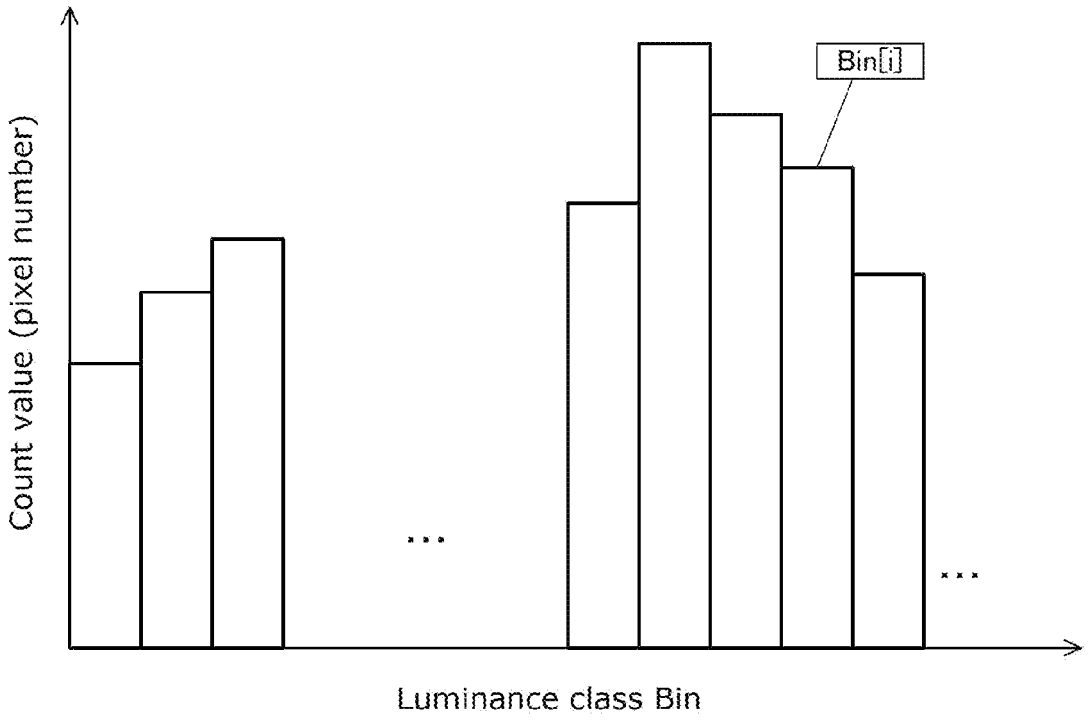
FIG. 4 is a diagram showing an example of a luminance histogram in which a plurality of first pixels contained in a single first frame are classified to each class of luminance values.

Here, a method of calculating the first luminance characteristic by extractor 121 is specifically described with reference to FIG. 4. FIG. 4 is a diagram showing an example of luminance histogram in which a plurality of the first pixels contained in a single first frame are classified in each class of the luminance values.

Extractor 121 counts pixels each having a luminance value in a luminance range corresponding to one of the respective classes, based on the first luminance value which each of a plurality of pixels that constitute a single first frame has, so as to generate a histogram shown in FIG. 4. The first luminance value is, for example, luminance Y in a case when the first video signal is represented by a YUV signal, and the first video signal is a MaxRGB indicating the maximum values of the respective R component, G component, and B component in the pixel value of a pixel included in a video signal in a case when the first video signal is represented by an RGB signal.

When counting the first pixels in descending order of luminance value, extractor 121 calculates an average of a plurality of the first luminance values in a plurality of the first pixels each having a luminance value in a predetermined range, as a first maximum value of a plurality of first luminance values, which is contained in the first luminance characteristic. The predetermined range is defined based on the first luminance values of the first pixels each having the count value that is a predetermined threshold value. Specifically, extractor 121 sums the counted values in the order from the largest luminance class in the histogram, and determines whether the summed count value exceeds the predetermined threshold value. For example, extractor 121 determines whether the count value in the class in which the luminance is largest exceeds the predetermined threshold value. If the count value does not exceed the threshold value, a count value in the secondarily largest luminance class is added to the count value that has been used for the first determination, and determines whether the summed count value exceeds the predetermined threshold value. The processing is repeated until the summed count value exceeds the predetermined threshold value. When the summed count value exceeds the predetermined threshold value, a summed class (Bin[i]) is identified. Then, extractor 121 calculates an average of the identified Bin[i] and the both sides of Bin[i], i.e., Bin[i+1] and Bin[i−1], as the first maximum value of a plurality of the first luminance values contained in the first luminance characteristic.

Furthermore, extractor 121 calculates a histogram average in the histogram, as a first average value of a plurality of the first luminance values contained in the first luminance characteristic. The histogram average can be calculated by Equation 1 below.

[Formula 1]

$$\text{The histogram average} = \frac{\sum_{i=0}^{n} (\text{Bin}[i] \times N1)}{N2} \quad \text{(Equation 1)}$$

Bin[$i$] : the representative value of rank $i$ $N1$ : count value (the number of pixel) of Bin[$i$]

$N2$ : total number of count value (total number of pixels)

The histogram average can be obtained in a manner that the representative value in each of the classes is multiplied by the count value of each of the classes to calculate the first value, and a total of the summed values of a plurality of the first values in the respective classes are divided by the total number of the count values. The representative value of each of the classes is a class value, and is obtained by dividing, by 2, the sum of the minimum value and the maximum value of the luminance range in the class.

It should be noted that extractor 121 is embodied by control circuit 103 and memory 104. Specifically, extractor 121 may be embodied in a manner that control circuit 103 executes a predetermined program stored in memory 104.

Determiner 122 determines a first backlight value, using the first luminance characteristic of the first video signal extracted by extractor 121. Determiner 122 outputs the determined first backlight value to tone map processor 123 and generator 113. The first backlight value is a reference luminance of backlight 105*b* of liquid crystal device 105 in liquid crystal display device 100. The first backlight value is also a duty value for controlling the maximum value of the luminance of backlight 105*b* of liquid crystal device 105 in order to achieve a displayed-image peak luminance that is a peak luminance of a video to be displayed in liquid crystal device 105. In other words, the first backlight value is a ratio of the displayed-image peak luminance relative to a display peak luminance of liquid crystal device 105. The first backlight value is indicated on percentage from 0 to 100%, for example. The first backlight value is one value defined for the entire of a single first frame in the first video.

Specifically, determiner 122 uses the first maximum value and the first average value extracted based on a plurality of first luminance values of a plurality of the first pixels that constitute each first frame to determine, for each of a plurality of the first frames, a weighted average of the first maximum value and the first average value as the first backlight value. Determiner 122 determines the first backlight value using Equation 2 below, for example.

$$\text{First backlight value} = a1 \times \text{first maximum value} + (1 - a1) \times \text{first average value} \quad \text{(Equation 2)}$$

In Equation 2, a1 denotes a weight relative to the first maximum value in a weighted average, (1−a1) denotes a weight relative to the first average value in the weighted average. a1 is indicated by a numerical value of 0 or more and 1 or less.

It should be noted that the weighted average is expressed by Equation 3, in which variate is set to x1, x2, x3, . . . , xn, and weight relative to these variates are respectively set to w1, w2, w3, . . . , wn.

[Formula 2]

$$\hat{x} = \frac{x1w1 + x2w2 + x3w3 + \ldots + xnwn}{w1 + w2 + w3 + \ldots + wn} = \frac{\sum_{i=1}^{n} xiwi}{\sum_{i=1}^{n} wi} \quad \text{(Equation 3)}$$

As mentioned above, determiner 122 sets the first maximum value of backlight 105*b* when displaying each of the first frames, to be the weighted average of the first maximum value and the first average value. Accordingly, even if the first maximum values each calculated from a plurality of the first luminance values are significantly different from each other between one first frame and a first frame next to the one first frame, sharpness of fluctuation in luminance of a video displayed in liquid crystal display device 100 can be reduced.

Figure 5:
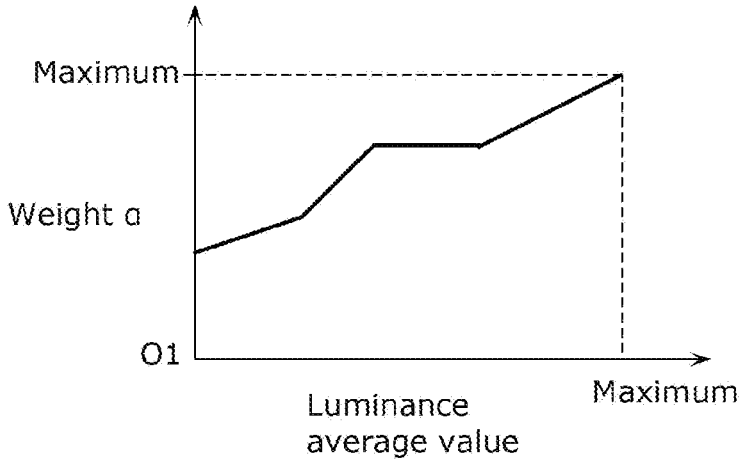
FIG. 5 is a graph showing relationship between an average value of luminance and weight a1 in the first frame.

Here, a1 can be defined to a value according to the luminance value of the first frame. FIG. 5 is a graph showing relationship between the average value of the luminance of the first frames and weight a1. For example, determiner 122 may determine a value of weight a1 relative to the first maximum value in the weighted average in such a manner that the larger the average value of a plurality of the first luminance values in the first frame to be processed, the larger the value of weight a1, as shown in FIG. 5.

It should be noted that determiner 122 is embodied by control circuit 103 and memory 104. Specifically, determiner 122 may be embodied in a manner that control circuit 103 executes a predetermined program stored in memory 104.

Tone map processor 123 performs tone mapping on the first video signal, based on the first backlight value and the peak luminance which liquid crystal device 105 of liquid crystal display device 100 can display, so as to output a second video signal obtained through the tone mapping. Specifically, tone map processor 123 calculates the displayed-image peak luminance when displaying the first frame by liquid crystal display device 100, from the peak luminance and the first backlight value, and generates a tone curve having the displayed-image peak luminance as the maximum luminance. Tone map processor 123 performs the tone mapping on the first video signal with using the generated tone curve, and outputs the second video signal obtained through the tone mapping to generator 113.

Here, the peak luminance which liquid crystal device 105 can display is previously stored in memory 104, for example. Here, the peak luminance which liquid crystal device 105 can display may be stored in another memory (not shown) provided in the exterior of control device 110 and installed inside liquid crystal display device 100. Tone map processor 123 obtains the peak luminance from memory 104 or another memory.

Figure 6:
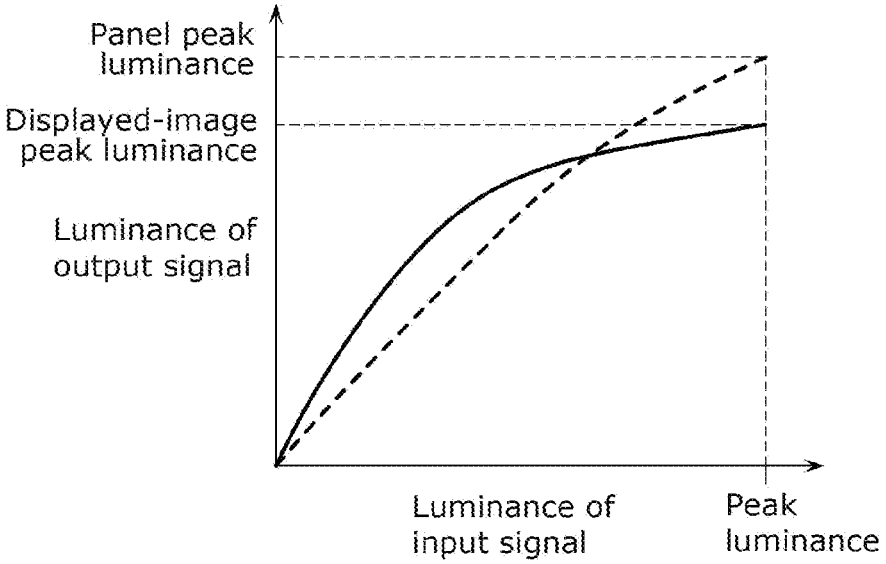
FIG. 6 is a tone curve showing relationship between luminance of an input signal and luminance of an output signal.

The tone curve to be used during the tone mapping by tone map processor 123 is used for calculating the displayed-image peak luminance as the maximum value when the peak luminance of an input signal is inputted, as shown in FIG. 6. In other words, the tone curve is used for converting the luminance of the input signal to an output signal according to the maximum luminance which liquid crystal device 105 can display. Furthermore, the tone curve is generated taking into account a gain of signal compensation in which the magnitude of luminance corresponding to the displayed-video luminance decreased by the first backlight value is compensated. A relationship between the backlight value and the gain of the signal compensation can be expressed by Equation 4 since the luminance is maintained at luminance of an original video signal.

$$\text{Backlight value}/100 \times \text{gain of signal compensation} = 1.0 \quad \text{(Equation 4)}$$

Thus, the gain of the signal compensation can be expressed by an inverse number of the backlight value. The video signal has a gamma characteristic, and thus the gain of the signal compensation can be expressed by Equation 5 and FIG. 7.

[Formula 3]

$$\text{Gain} = \frac{1}{\text{Backlight Duty}^{\frac{1}{\gamma}}} \quad \text{(Equation 5)}$$

In Equation 5, "Gain" denotes the gain of the signal compensation, "Backlight Duty" denotes a backlight value, i.e., the first backlight value. In addition, "$\gamma$" denotes a gamma characteristic value of the video signal. The gamma is a value of 2.2, 2.0, 1.8, and so on, for example.

As described above, the first backlight value is a value defined for the entire of a single first frame of the first video, so that the gain of the signal compensation is defined for the entire of a single first frame of the first video.

Figure 7:
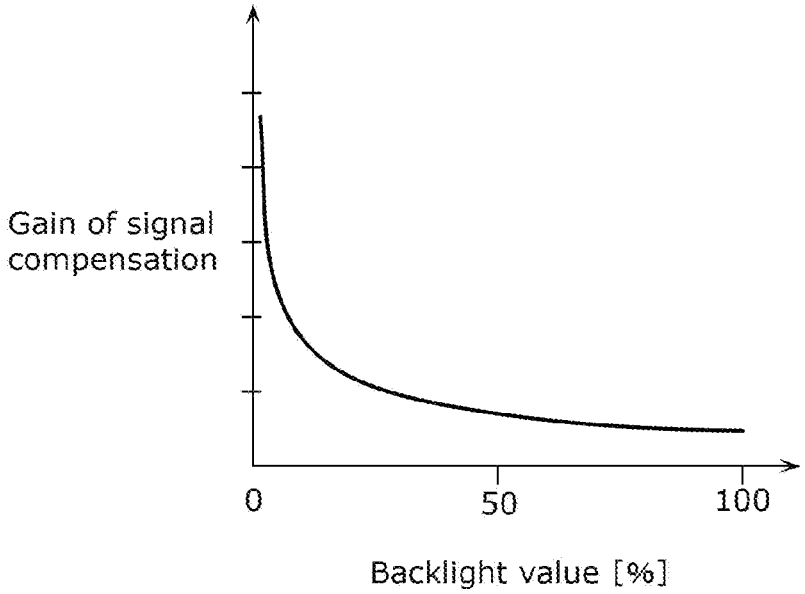
FIG. 7 is a graph showing relationship between a gain of signal compensation and a backlight value.

FIG. 6 is a tone curve showing relationship between luminance of an input signal and luminance of an output signal. In addition, FIG. 7 is a graph showing relationship between the gain of the signal compensation and the backlight value.

It should be noted that tone map processor 123 is embodied by control circuit 103 and memory 104. Specifically, tone map processor 123 may be embodied in a manner that control circuit 103 executes a predetermined program stored in memory 104.

Next, generator 113 is described.

Generator 113 generates a control signal for local dimming control on liquid crystal display device 100, based on the first backlight value and the second video signal, which are generated in video signal processor 112. Generator 113 outputs the generated control signal to liquid crystal device 105 of liquid crystal display device 100. Generator 113 generates a control signal for each of a plurality of areas that constitute a second frame included in the second video represented by the second video signal. It should be noted that generator 113 is embodied by control circuit 103 and memory 104. Specifically, generator 113 may be embodied in a manner that control circuit 103 executes a predetermined program stored in memory 104.

Figure 8:
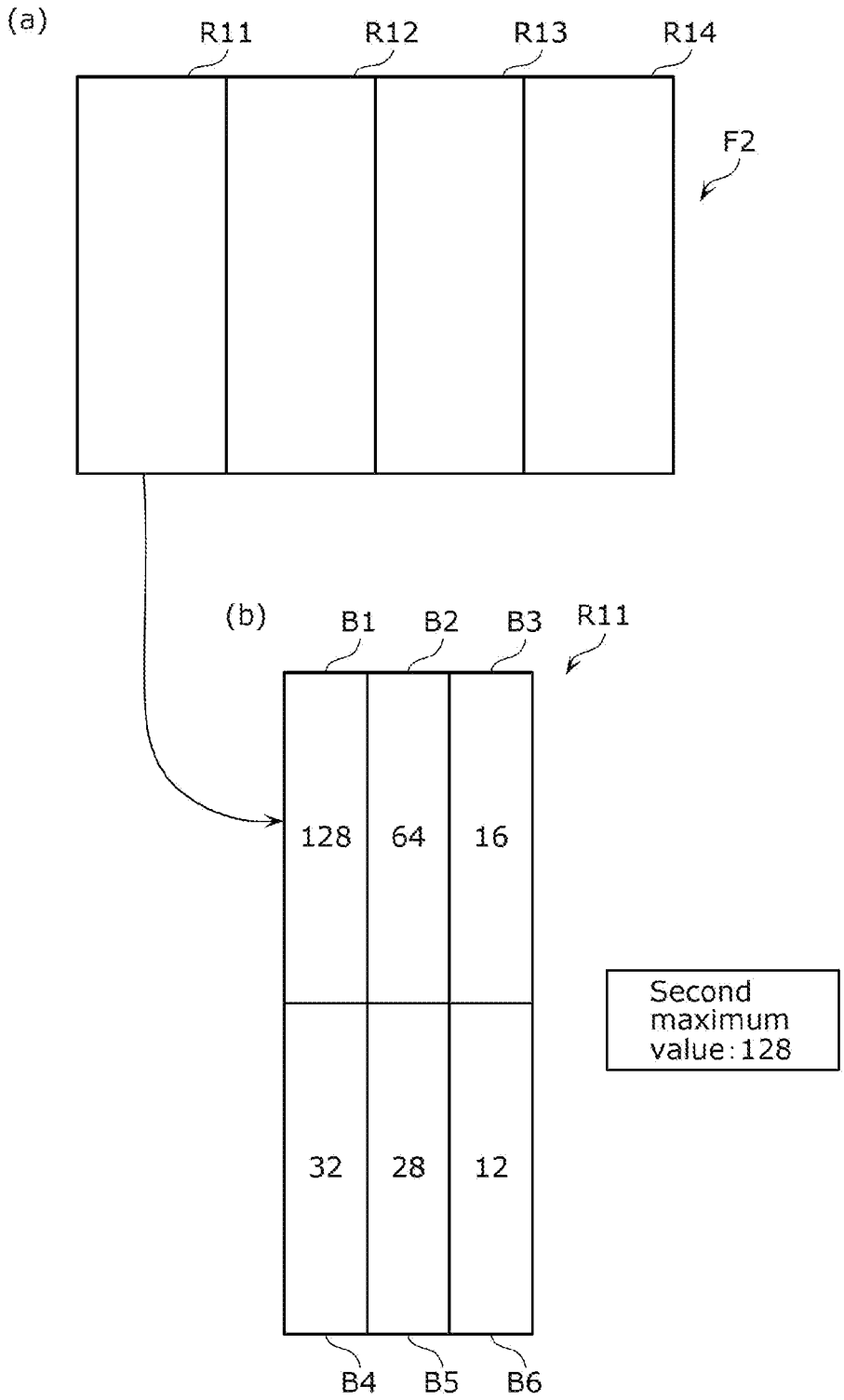
FIG. 8 is a diagram showing an example of calculation of a second luminance characteristic for each of a plurality of areas in which luminance of the backlight of a liquid crystal device is independently controlled in local dimming control.

Here, the relationship between the second frame and a plurality of areas is described with reference to FIG. 8. FIG. 8 is a diagram showing an example of calculating a second luminance characteristic for each of a plurality of areas, in which the luminance of the backlight of a liquid crystal device is independently controlled in the local dimming control.

Second frame F2 included in the second video is segmented into a plurality of regions R11 to R14, as shown in (a) of FIG. 8. A plurality of regions R11 to R14 correspond to regions in each of which the luminance of backlight 105*b* of liquid crystal device 105 is independently controlled in local dimming control. Generator 113 generates a plurality of control signals respectively corresponding to a plurality of regions R11 to R14. It has been described that one second frame F2 is segmented into four regions R11 to R14. However, it is not limited for second frame F2 to be divided into four regions R11 to R14, as long as second frame F2 is segmented into two or more regions. Second frame F2 may contain a plurality of blocks different from a plurality of regions R11 to R14. A minimum region, the luminance of which is independently controlled in backlight 105*b*, may correspond to two or more blocks, or correspond to a single block. Furthermore, the second frame to be processed is a frame of the second video signal, which corresponds to the first frame that underlies the calculation of the first backlight value. Generator 113 includes extractor 131, determiner 132, gain adjustor 133, and control signal generator 134. Extractor 131, determiner 132, gain adjustor 133 perform the same processing to each of a plurality of regions R11 to R14 that constitute second frame F2. Thus, the processing to one region R11 may be described as representative.

Extractor 131 extracts a second luminance characteristic in region R11. Extractor 131 extracts the second luminance characteristic in region R11, based on a plurality of second luminance values each of which is contained in the corresponding one of a plurality of second pixels contained in region R11. A plurality of the second pixels in region R11 are a part of a plurality of second pixels that constitute the second frame of the second video signal, and are contained in region R11. The second luminance characteristic includes, for example, the maximum value of a plurality of the second luminance values (hereinafter, referred to as a second maximum value), and an average value of a plurality of the second luminance values (hereinafter, referred to as a second average value), in region R11. Region R11 corresponds to a plurality of blocks B1 to B6 (six blocks in the present embodiment), and is a region for controlling the luminance of a plurality of blocks B1 to B6. Region R11 includes a plurality of blocks B1 to B6. Similarly, other regions R12 to R14 respectively correspond to a plurality of unillustrated blocks (six blocks in the present embodiment), and are regions for controlling the luminance of the corresponding blocks. Each of regions R12 to R14 includes a plurality of unillustrated blocks.

(b) of FIG. 8 is an example of maximum values of a plurality of second luminance values each of which is provided in the corresponding one of a plurality of the second pixels in a plurality of blocks B1 to B6. In this case, the maximum one of the maximum values of block B1 to B6 may be determined as a second maximum value of region R11. Similarly, when an average value of a plurality of second luminance values each of which is provided in the corresponding one of a plurality of the second pixels in the respective blocks B1 to B6 has been calculated, an average of the average values of the respective blocks B1 to B6 may be determined as a second average value of region R11.

Determiner 132 determines a second backlight value in each region using the second luminance characteristic of each region, which is extracted by extractor 131. The second backlight value is to be the reference luminance of backlight 105*b*, which corresponds to each region. The second backlight value is also a duty value for controlling the luminance of each of a plurality of light sources of backlight 105*b* of liquid crystal display device 105 in order to achieve region peak luminance that is the peak luminance of each region of a video to be displayed. In other words, the second backlight value is a ratio of the region peak luminance in each region, relative to the displayed-video luminance. The second backlight value is indicated with a value from 0 to 100%. The second backlight value is a plurality of values defined for each of a plurality of the regions of a single second frame in the second video.

Specifically, determiner 132 determines, for each of a plurality of regions R11 to R14, a weighted average of a second maximum value and a second average value as a second backlight value in the regions, using the second maximum value and the second average value which are extracted based on a plurality of the second luminance values of a plurality of the second pixels that constitute each of regions R11 to R14. Determiner 132 determines a second backlight value using Equation 6 below, for example.

$$\text{Second backlight value} = a2 \times \text{second maximum value} + (1-a2) \times \text{second average value} \quad \text{(Equation 6)}$$

In Equation 6, a2 denotes a weight relative to the second maximum value in the weighted average, (1−a2) denotes a weight relative to the second average value in the weighted average. a2 is indicated by a numerical value of 0 or more and 1 or less.

As mentioned above, determiner 132 sets the maximum value of luminance of backlight 105*b* when displaying each of the second frames, to be the weighted average of the second maximum value and the second average value. Accordingly, even if the second maximum values each calculated from a plurality of second luminance values are significantly different from each other between one second frame and a second frame next to the one second frame, sharpness of fluctuation in the luminance of a video displayed in liquid crystal display device 100 can be reduced. Here, a2 can be determined to a value according to the luminance value of the second frame, in the similar manner as a1.

It should be noted that determiner 132 is embodied by control circuit 103 and memory 104. Specifically, determiner 132 may be embodied in a manner that control circuit 103 executes a predetermined program stored in memory 104.

Gain adjustor 133 determines a gain of signal compensation to the second video signals respectively corresponding to regions R11 to R14, based on the second backlight values in regions R11 to R14. Gain adjustor 133 compensates the second video signal corresponding to each of regions R11 to R 14, using the gain of the signal compensation in each of the determined regions R11 to R14, and generates a third video signal obtained by compensating the second video signal corresponding to each of regions R11 to R14. The second video signal corresponding to each of regions R11 to R14 is a video signal indicating a video of each of regions R11 to R14, when the second frame represented by the second video signal is divided into a plurality of regions R11 to R14. Gain adjustor 113 outputs a third video signal to control signal generator 134. Relationship between the second backlight value and the gain of the signal compensation can be expressed by Equation 4, since the luminance is maintained at luminance of an original video signal, as described above.

Accordingly, the gain of the signal compensation can be expressed by an inverse number of the backlight value. The video signal has a gamma characteristic, and thus the gain of the signal compensation can be expressed similarly as in Equation 5 and FIG. 7.

It should be noted that gain adjustor 133 is embodied by control circuit 103 and memory 104. Specifically, gain adjustor 133 may be embodied in a manner that control circuit 103 executes a predetermined program stored in memory 104.

Control signal generator 134 calculates a third backlight value for each of regions R11 to R14, based on the first backlight value and the second backlight value that is determined for each of regions R11 to R14. Control signal generator 134 also generates, as a control signal for local dimming control, the calculated third backlight value for each of regions R11 to R14 and the third video signal generated by gain adjustor 133, and outputs the generated control signal to liquid crystal device 105. In other words, control signal generator 134 generates a control signal containing: the third backlight value for controlling a plurality of light sources of backlight 105*b* in each of regions R11 to R14; and the third video signal for controlling liquid crystal panel 105*a* in each of regions R11 to R14. Then, control signal generator 134 outputs control signals respectively corresponding to a plurality of regions R11 to R14, to liquid crystal device 105. The third backlight value and the third video signal which are contained in a control signal are allocated to a single frame of a video. Thus, the control signal is generated for each frame.

It should be noted that control signal generator 134 is embodied by control circuit 103 and memory 104. Specifically, control signal generator 134 may be embodied in a manner that control circuit 103 executes a predetermined program stored in memory 104.

2. Operation

Figure 9:
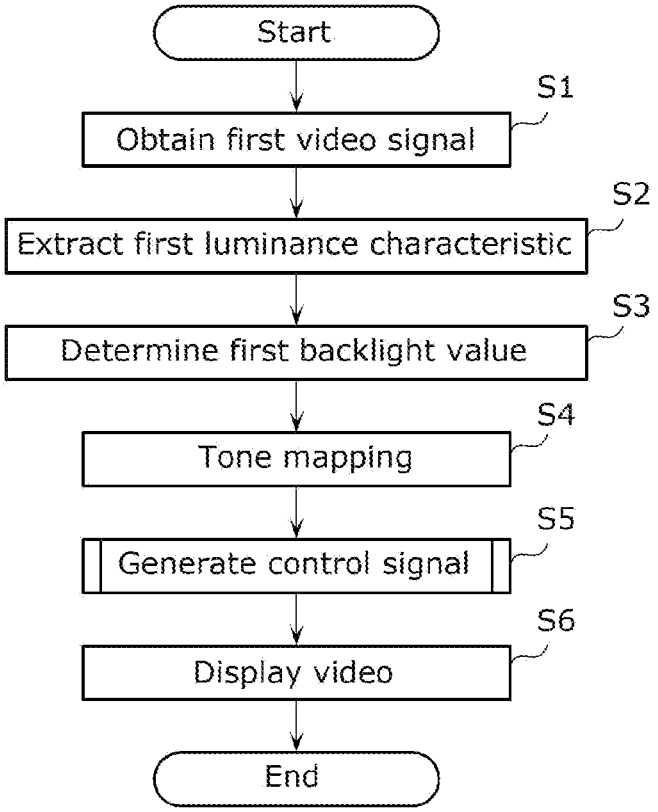
FIG. 9 is a flowchart showing an operation of the liquid crystal display device.

Next, operation of liquid crystal display device 100 is described. FIG. 9 is a flowchart showing an operation of the liquid crystal display device. It should be noted that Steps S1 to S5 in the flowchart are also applicable to a flowchart of an operation of control device 110.

Control device 110 of liquid crystal display device 100 obtains the first video signal (Step S1). Step S1 has been described in detail in the processing of obtainer 111 of control device 110, so that the detailed description of Step S1 is omitted.

Then, control device 110 extracts the first luminance characteristic of the first video signal, from the first video signal (Step S2). Step S2 has been described in detail in the processing of extractor 121 of video signal processor 112 of control device 110, so that the detailed description of Step S2 is omitted.

Next, control device 110 determines the first backlight value that is to be the reference luminance of backlight 105*b* of liquid crystal display device 100, using the extracted first luminance characteristic (Step S3). Step S3 has been described in detail in processing of determiner 122 of video signal processor 112 of control device 110, so that the detailed description of Step S3 is omitted.

Then, control device 110 performs the tone mapping on the first video signal obtained in Step S1, based on the first backlight value and the peak luminance which liquid crystal device 105 of liquid crystal display device 100 can display, so as to output the second video signal that has obtained through the tone mapping (Step S4). Step S4 has been described in detail in the processing of tone map processor 123 of video signal processor 112 of control device 110, so that the detailed description of Step S4 is omitted.

Thereafter, control device 110 generates a control signal for local dimming control on liquid crystal display device 100, based on the first backlight value and the second video signal, and outputs the generated control signal to liquid crystal device 105 of liquid crystal display device 100 (Step S5). Step S5 is described later in detail, with reference to FIG. 10.

Next, liquid crystal device 105 of liquid crystal display device 100 displays a video based on the outputted control signal (Step S6). Specifically, liquid crystal device 105 controls a plurality of light sources of backlight 105*b* in each of region R11 to R14, using the third backlight value in each of regions R11 to R14 contained in the control signal. At the same time as the controlling of backlight 105*b*, liquid crystal device 105 controls liquid crystal panel 105*a* with using the third video signal contained in the control signal. Thus, liquid crystal device 105 controls backlight 105*b* with using the third backlight value in each of regions R11 to R14, and controls liquid crystal panel 105*a* with using the third video signal, so as to display a video in accordance with the control signal.

Figure 10:
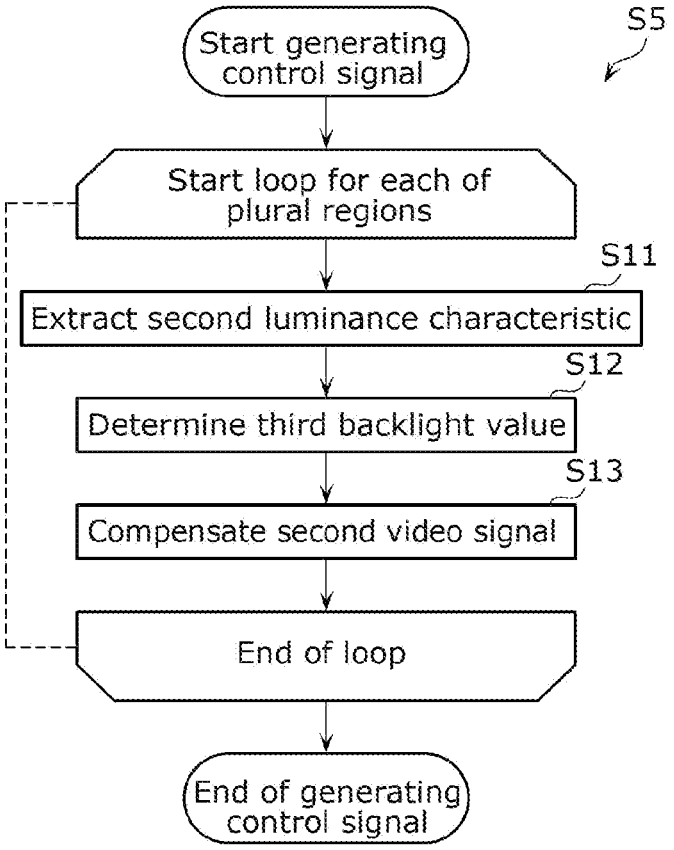
FIG. 10 is a flowchart showing processing of generating a control signal (Step S5).

FIG. 10 is a flowchart of generation processing (Step S5) of the control signal.

Step S5 is performed in generator 113 of control device 110.

Generator 113 starts a loop for each of a plurality of the regions that constitute the second frame contained in the second video of the second video signal. In the loop, Steps S11 to S13 are performed.

Generator 113 extracts the second luminance characteristic in a region subjected to the processing, from the region subjected to the processing (Step S11). Step S11 has been described in detail in the processing of extractor 131 of generator 113, so that the detailed description of Step S11 is omitted.

Generator 113 determines the third backlight value in the region subjected to the processing, based on the first backlight value and the second backlight value that has been determined in the region subjected to the processing (Step S12).

Generator 113 determines the gain of the signal compensation in the region subjected to the processing, based on the second backlight value in the region subjected to the processing, and compensates the second video signal in the region subjected to the processing, according to the determined gain, thereby generating a third video signal (Step S13).

Steps S12 and S13 has been described in detail in the processing of determiner 132, gain adjustor 133, and control signal generator 134, which are in generator 113, so that the detailed descriptions of Steps S12 and S13 are omitted.

Generator 113 completes the loop for every region of a plurality of the regions, and then terminates the loops.

3. Effects and so On

In control device 110 according to the present embodiment, a control signal for the local dimming control of liquid crystal device 105 of liquid crystal display device 100 is generated based on: the first backlight value determined using the first luminance characteristic of the first video signal; and the second video signal obtained by performing the tone mapping on the first video signal. Accordingly, it is possible to perform, to liquid crystal device 105, the local dimming control according to the second video signal adjusted in accordance with the peak luminance of a video displayed in liquid crystal device 105 using the first luminance characteristic. As such, the peak luminance of the second video signal is reduced according to the displayed-image peak luminance, so that the second video signal has the luminance lower than or equal to the luminance of the first video signal. Accordingly, the black floating of a dark section in a video to be displayed in liquid crystal device 105 is sufficiently reduced, and a contrast ratio of the video can be sufficiently improved.

In addition, in control device 110 according to the present embodiment, tone map processor 123 calculates the displayed-image peak luminance when displaying a single first frame in liquid crystal device 105, from the peak luminance and the first backlight value, and performs the tone mapping with using a tone curve having the displayed-image peak luminance as the maximum luminance. Accordingly, the second video signal adjusted according to the peak luminance of the video to be displayed in liquid crystal device 105 using the first luminance characteristic can be generated.

In control device 110 according to the present embodiment, generator 113 generates a control signal for the local dimming control on liquid crystal display device 105, based on the first backlight value and the second video signal. Accordingly, the local dimming control according to the second video signal can be appropriately performed, so that the black floating of a dark section in a video displayed in liquid crystal device 105 can be sufficiently reduced, and a contrast ratio of the video can be sufficiently improved.

4. Modified Example

Although control device 110 is installed in liquid crystal display device 100 in the embodiment described above, it is not limited thereto. Control device 110 may be another device separated from liquid crystal display device 100. For example, control device 110 may be a recorder, a set-top box, and such an exterior device connected to liquid crystal display device 100. In this case, control device 110 and liquid crystal display device 100 may be connected in a wired manner using high-definition multimedia interface (HDMI) (registered trademark) cable, or may be connected in a wireless manner. It is merely required that control device 110 and liquid crystal display device 100 are connected in communicable manner.

Although video signal processor 112 of control device 110 analyzes the first video signal so as to have extractor 121 that extracts the first luminance characteristic in the embodiment above, video signal processor 112 may not have extractor 121 in a case when the first luminance characteristic is contained in the first video signal as metadata. In other words, video signal processor 112 of control device 110 may obtain the first luminance characteristic from the metadata of the first video signal. The first luminance characteristic may be dynamic metadata.

Although video signal processor 112 and generator 113 are each constituted by control circuit 103 in the embodiment above, a control circuit having the function of video signal processor 112 and a control circuit having the function of generator 113 may be unified or separated.

Although liquid crystal display device 100 is provided with tuner 101, and control device 110 obtains a first video signal based on a broadcast wave received via tuner 101 in the embodiment above, it is not limited thereto. Control device 110 may obtain the first video signal that is obtained by reading video data recorded in a recording media (a predetermined package media), such as an optical disk. In this case, control device 110 may be provided with an electrical appliance including an optical pickup that performs reading on an optical disk. Furthermore, control device 110 may obtain the first video signal from an exterior server via a network, such as the Internet. In this case, control device 110 may be provided with a communication IF for communicating with an exterior server.

As described above, embodiments have been described as examples of technique of the present disclosure. For the description, the accompanied drawings and the detailed disclosure are provided.

Therefore, structural components described in the accompanied drawings and the detailed description may include not only structural components that are necessary for solving problems, but also structural components that are not necessary for solving the problems, for exemplifying the above technique. Accordingly, it should not immediately recognize that those unnecessary structural components are necessary, based on that those unnecessary structural components are described in the accompanied drawings and the detailed description.

Since the embodiments above are described for exemplifying the technique in the present disclosure, various modifications, replacement, addition, omission, and so on can be conducted in a scope of claims and in scopes equivalent thereto.

INDUSTRIAL APPLICABILITY

The present disclosure is useful as a control device and a control method, by which black floating of a dark section in a video to be displayed in a liquid display device can be sufficiently reduced, and a contrast ratio of the video can be sufficiently improved.

The invention claimed is:

1. A control device that controls a liquid crystal display device, the control device comprising:

an obtainer that obtains a first video signal;

a determiner that determines a first backlight value as a reference luminance of a backlight of the liquid crystal display device, using a first luminance characteristic of the first video signal;

a tone map processor that performs tone mapping on the first video signal based on the first backlight value and a peak luminance displayable by the liquid crystal display device, and outputs a second video signal obtained through the tone mapping; and a generator that generates a control signal for local dimming control on the liquid crystal display device based on the first backlight value and the second video signal, and outputs the control signal to the liquid crystal display device, wherein the tone map processor calculates a displayed-image peak luminance when displaying a single first frame by the liquid crystal display device, from the peak luminance and the first backlight value, and performs the tone mapping with using a tone curve having the displayed-image peak luminance as a maximum luminance, the single first frame being included in a first video to be represented by the first video signal.

2. The control device according to claim 1, wherein the first luminance characteristic includes a maximum value of a plurality of first luminance values and an average value of the plurality of first luminance values, the plurality of first luminance values being respectively of a plurality of first pixels that constitute the single first frame, the first video includes a plurality of first frames including the single first frame, and the determiner determines, for each of the plurality of first frames, a weighted average of the maximum value and the average value of the plurality of first luminance values that constitute each of the plurality of first frames as the first backlight value.

3. The control device according to claim 2, wherein a weight given to the maximum value in the weighted average is set to increase in proportion to an increase in the average value of the plurality of first luminance values in a first frame to be processed.

4. The control device according to claim 2, wherein when the plurality of first pixels are counted in descending order of luminance value, the maximum value is an average of the plurality of first luminance values of the plurality of first pixels each having a luminance value within a predetermined range in which a first luminance value of a first pixel counted at a number corresponding to a count value that is a predetermined threshold value is a reference luminance.

5. The control device according to claim 2, wherein the average value is a histogram average in a histogram indicating, for each of a plurality of luminance-value classes, a total number of pixels each having a luminance value categorized into a corresponding one of the plurality of luminance-value classes.

6. The control device according to claim 2, wherein for each of a plurality of regions constituting a second frame that is included in a second video represented by the second video signal, and corresponds to the first frame, the generator:

(i) determines a second backlight value in the region using a second luminance characteristic of the region;

(ii) determines a gain of signal compensation to the second video signal for the region based on the second backlight value in the region, and compensates the second video signal in the region using the gain determined for the region; and generates, as the control signal, a third backlight value in each of the plurality of regions, and a third video signal obtained by compensating the second video signal in each of the plurality of regions, the third backlight value being calculated based on the first backlight value and the second backlight value that is determined in each of the plurality of regions.

7. A control method for controlling a liquid crystal display device, the control method comprising:

obtaining a first video signal;

determining a first backlight value as a reference luminance of a backlight of the liquid crystal display device, using a first luminance characteristic of the first video signal;

performing tone mapping on the first video signal based on the first backlight value and a peak luminance displayable by the liquid crystal display device, and outputting a second video signal obtained through the tone mapping;

generating a control signal for local dimming control on the liquid crystal display device based on the first backlight value and the second video signal; and outputting the control signal to the liquid crystal display device, wherein in the performing of the tone mapping, a displayed-image peak luminance when displaying a single first frame by the liquid crystal display device is calculated from the peak luminance and the first backlight value, and the tone mapping is performed with using a tone curve having the displayed-image peak luminance as a maximum luminance, the single first frame being included in a first video to be represented by the first video signal.

8. A control device that controls a liquid crystal display device, the control device comprising:

an obtainer that obtains a first video signal;

a determiner that determines a first backlight value as a reference luminance of a backlight of the liquid crystal display device, using a first luminance characteristic of the first video signal;

a tone map processor that performs tone mapping on the first video signal based on the first backlight value and a peak luminance displayable by the liquid crystal display device, and outputs a second video signal obtained through the tone mapping; and a generator that generates a control signal for local dimming control on the liquid crystal display device based on the first backlight value and the second video signal, and outputs the control signal to the liquid crystal display device, wherein:

the first luminance characteristic includes a maximum value of a plurality of first luminance values and an average value of the plurality of first luminance values, the plurality of first luminance values being respectively of a plurality of first pixels that constitute a single first frame included in a first video to be represented by the first video signal, the first video includes a plurality of first frames including the single first frame, and the determiner determines, for each of the plurality of first frames, a weighted average of the maximum value and the average value of the plurality of first luminance values that constitute each of the plurality of first frames as the first backlight value.

9. The control device according to claim 8, wherein a weight given to the maximum value in the weighted average is set to increase in proportion to an increase in the average value of the plurality of first luminance values in a first frame to be processed.

10. The control device according to claim 8, wherein when the plurality of first pixels are counted in descending order of luminance value, the maximum value is an average of the plurality of first luminance values of the plurality of first pixels each having a luminance value within a predetermined range in which a first luminance value of a first pixel counted at a number corresponding to a count value that is a predetermined threshold value is a reference luminance.

11. The control device according to claim 8, wherein the average value is a histogram average in a histogram indicating, for each of a plurality of luminance-value classes, a total number of pixels each having a luminance value categorized into a corresponding one of the plurality of luminance-value classes.

12. The control device according to claim 8, wherein for each of a plurality of regions constituting a second frame that is included in a second video represented by the second video signal, and corresponds to the first frame, the generator:

(i) determines a second backlight value in the region using a second luminance characteristic of the region;

(ii) determines a gain of signal compensation to the second video signal for the region based on the second backlight value in the region, and compensates the second video signal in the region using the gain determined for the region; and generates, as the control signal, a third backlight value in each of the plurality of regions, and a third video signal obtained by compensating the second video signal in each of the plurality of regions, the third backlight value being calculated based on the first backlight value and the second backlight value that is determined in each of the plurality of regions.

* * * * *